US006489858B2

(12) United States Patent
Barker et al.

(10) Patent No.: US 6,489,858 B2
(45) Date of Patent: Dec. 3, 2002

(54) H-PLANE OFFSET TRANSITIONS IN A SWITCHABLE WAVEGUIDE

(75) Inventors: James M. Barker, Torrance, CA (US); Rolf Kich, Redondo Beach, CA (US); Richard L. Bennett, Torrance, CA (US)

(73) Assignee: The Boeing Company, Chicago, IL (US)

( * ) Notice: Subject to any disclaimer, the term of this patent is extended or adjusted under 35 U.S.C. 154(b) by 14 days.

(21) Appl. No.: 09/814,914

(22) Filed: Mar. 21, 2001

(65) Prior Publication Data

US 2002/0135436 A1 Sep. 26, 2002

(51) Int. Cl.[7] ..... H01P 1/10
(52) U.S. Cl. ..... 333/106; 333/108; 333/258
(58) Field of Search ..... 333/106, 108, 333/258, 121, 122, 107, 101, 105

(56) References Cited

U.S. PATENT DOCUMENTS 4,242,652 A * 12/1980 Shishido et al. ..... 333/106
4,642,586 A * 2/1987 Fowler ..... 333/122
5,347,243 A * 9/1994 Kich et al. ..... 333/106
6,201,906 B1 * 3/2001 Kich et al. ..... 385/22

* cited by examiner

*Primary Examiner*—Robert Pascal
*Assistant Examiner*—Dean Takaoka
(74) *Attorney, Agent, or Firm*—Gates & Cooper LLP

(57) ABSTRACT

An apparatus and method for switching waveguides between T switch and a bypass waveguide. The apparatus comprises a housing having a first, second and third housing port and a waveguide rotor, having a first and second rotary position. The waveguide rotor includes a first T waveguide, having a first and second T port, for connecting the second and third housing ports in the first rotary position, a second T waveguide having a third and fourth T port, for connecting the first and fourth housing ports in the first rotary position and a bypass waveguide, having a first and second bypass port, for connecting the first and second housing ports in the second rotary position. The first and second rotary positions are alternately selectable by rotating the waveguide rotor.

The method comprises rotating a waveguide rotor including a first T waveguide having a first and second T port, a second T waveguide having a third and fourth T port and a bypass waveguide having a first and second bypass port, to a first rotary position in a housing including a first, second and third housing port, whereby the first and second T ports connect the first and fourth housing ports and the third and fourth T ports connect the second and third housing ports. And rotating the waveguide rotor to a second rotary position, whereby the first and second bypass ports connect the first and second housing ports.

29 Claims, 4 Drawing Sheets

H-PLANE OFFSET TRANSITIONS IN A SWITCHABLE WAVEGUIDE

BACKGROUND OF THE INVENTION

1. Field of the Invention

The present invention relates to systems and methods for electromagnetic waveguides, and in particular to systems and methods for switchable electromagnetic waveguides in spacecraft.

2. Description of the Related Art

In spacecraft applications, the payload architecture may comprise Traveling Wave Tube Amplifiers (TWTAs) interconnected in redundancy rings to improve the overall system reliability. The redundancy rings allow a changeover of TWTAs without a service interruption. Switchable waveguides may be used in the design of such redundancy rings to switch the TWTA connections.

One such switchable waveguide is a T switch. When engaged, a T switch opens two straight waveguide paths which cross and connect pairs of opposite ports. Using a T switch, a redundant TWTA downstream can be switched into service without interfering with other paths in the power circuit. Known coaxial T switches are not capable of handling high power as hollow waveguides. Furthermore, high power coaxial T switches cannot be made as compactly as hollow waveguide switches.

Another kind of switchable waveguide is an R switch. R switches include a single straight waveguide path and two bypass waveguide paths. Either the straight waveguide or the bypass waveguides may be engaged at any time.

Furthermore, in the design of spacecraft, there are certain constant desirable objectives, which tend to vary only in emphasis for any particular application. These include reducing the mass and size of spacecraft components, reducing the time required to build components, improving the manufacturability, and of course, reducing component cost.

There is a need in the art for smaller, lighter, simpler and cheaper devices and methods for switching and combining electromagnetic signals. Particularly, there is a need for a switch combining the functionality of both a T switch and an R switch in a single compact device.

The present invention satisfies these needs.

SUMMARY OF THE INVENTION

To address the requirements described above, the present invention discloses an apparatus and method for switching electromagnetic radiation conducted through waveguides that is lighter, simpler and less costly than prior art devices.

A waveguide switch of the present invention comprises a housing having a first, second, third and fourth housing port and a waveguide rotor, having a first and second rotary position. The waveguide rotor includes a first T waveguide, having a first and second T port, for connecting the first and fourth housing ports in the first rotary position, a second T waveguide having a third and fourth T port, for connecting the second and third housing ports in the first rotary position and a bypass waveguide, having a first and second bypass port, for connecting the first and second housing ports in the second rotary position. The first and second rotary positions are alternately selectable by rotating the waveguide rotor.

A method of switching waveguides of the present invention comprises rotating a waveguide rotor including a first T waveguide having a first and second T port, a second T waveguide having a third and fourth T port and a bypass waveguide having a first and second bypass port, to a first rotary position in a housing including a first, second, third and fourth housing port, whereby the first and second T ports connect the first and fourth housing ports and the third and fourth T ports connect the second and third housing ports. And rotating the waveguide rotor to a second rotary position, whereby the first and second bypass ports connect the first and second housing ports.

The H-plane offset waveguide transition of the present invention allows a ridged guide with a width of approximately ½ the standard "a" dimension to connect to a transition step, while offset completely to one side. The short wall of the ridged guide is approximately centered when mated to the transition step. The mirror image configuration has the ridged waveguide slid completely over to the other edge of the transition step. Effectively, two different waveguides on two different planes in a rotor can be switched to a common housing port.

One embodiment of the present invention uses the H-plane offset waveguide transition to combine the functionality of a T switch and an R switch in a single compact switch. The three standard paths of an R switch waveguide layout in a waveguide rotor, a straight waveguide (hereinafter referred to as a "T waveguide") and two bypass waveguides, are disposed on a first plane in the rotor. When rotated into position, they connect to the first section of the vertically positioned transformer openings in the housing, the housing ports.

The final crossed connection required for the T switch function, via a second T waveguide, is disposed on a plane below the standard R switch configuration and substantially orthogonal to the other T waveguide. The second T waveguide is also double-ridged. This entire configuration fits into the same compact rotor volume presently used in the standard R switch. When rotated into position, this double-ridged T waveguide connects to the second section of the housing ports.

The H-plane offset transitions allow lighter, simpler and more inexpensive devices and methods for switching and combining electromagnetic signals than presently known in the art. Combining these functions in a single unit reduces the switch mass as well as the harness and interconnecting waveguide lengths.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
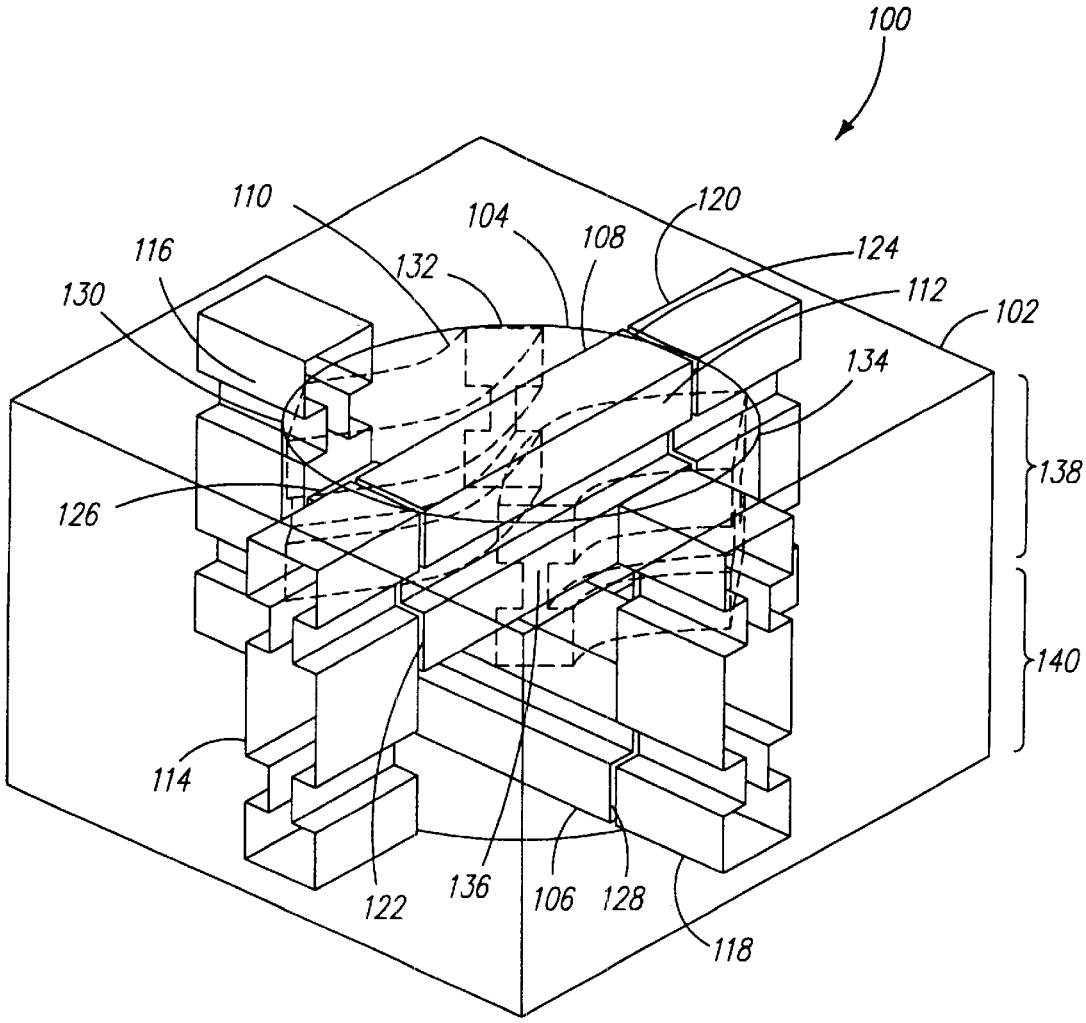
FIG. 1 illustrates one embodiment of the invention using H-plane offset transitions.

FIG. 1 illustrates one embodiment of the invention using H-plane offset transitions to combine the functionality of a T switch and an R switch. The H-plane offset waveguide switch 100 includes a housing 102, and a waveguide rotor 104 which rotates in the housing 102 to select various positions connecting the four housing ports 114, 116, 118, 120 in different combinations.

Depending upon the position of the waveguide rotor 104, connection of the housing ports 114, 116, 118, 120 is made through rotor waveguides, either T waveguides 106, 108 or bypass waveguides 110, 112.

The waveguide rotor 104 is divided into a first and second plane 138, 140. The first plane 138 comprises a straight path 106 and the two curved paths 110, 112. The second plane 140 contains a second straight path 108, orthogonal to the first straight path 106. The first and second straight paths, T waveguides 106, 108, are used to provide the functionality of a T switch. As they rotate so that their T ports 122, 124, 126, 128 engage the quad-ridge housing ports 114, 116, 118, 120, electrically matched paths are created at each port connection.

Figure 2B:
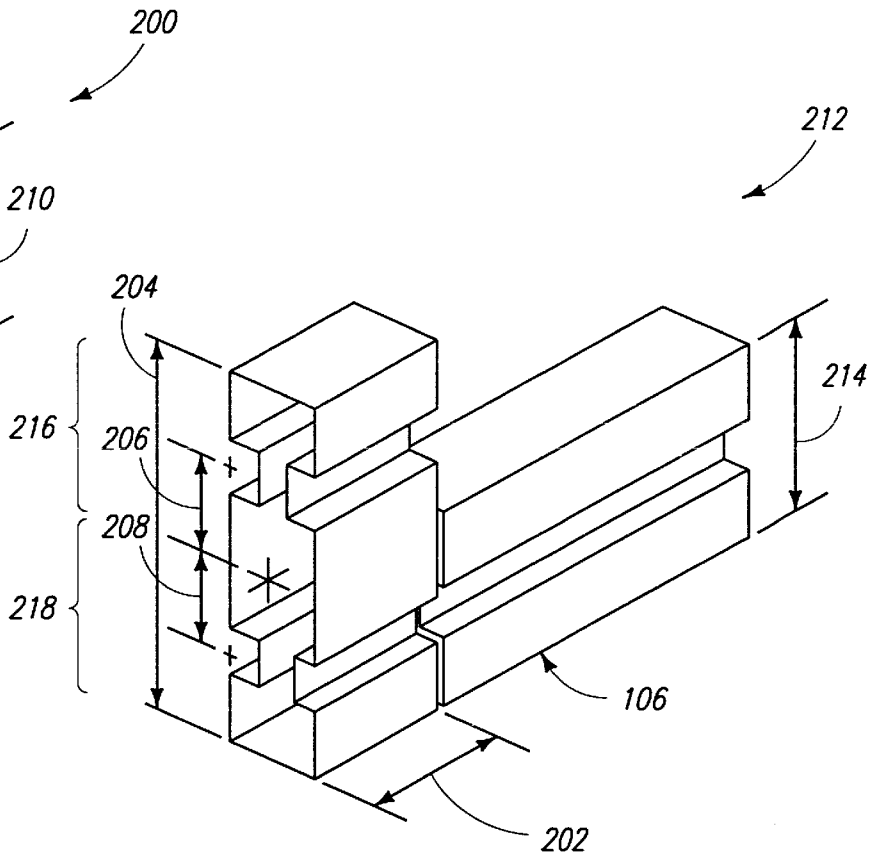
FIGS. 2A–2B illustrate the H-plane offset transitions.
Figure 2A:
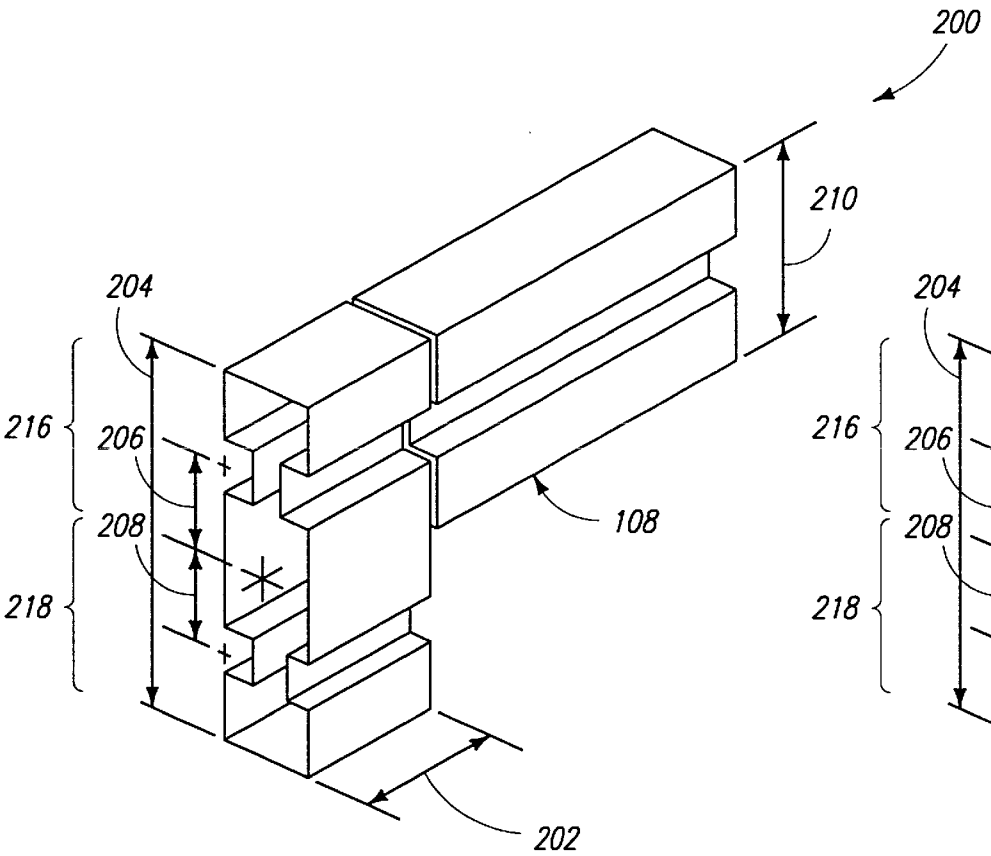

FIGS. 2A–2B illustrate H-plane offset transitions 200, 212. The H-plane offset transitions 200, 212 form the port connections. The H-plane offset transitions 200, 212 allow the T waveguides 106, 108 to crossed connection of housing ports 114, 116, 118, 120 of the T switch 100. Used in the waveguide rotor 104, this feature allows an over/under arrangement of the T waveguides 106, 108. The overall configuration fits into the same compact rotor volume presently used in a standard R switch which has only a straight path and two bypass paths.

In one embodiment of the present invention, the H-plane offset transitions 200, 212 comprise housing ports 114, 116, 116, 118 with a quad-ridged transition 202 having "a" dimension 204. Two of the four ridges are disposed at approximately ¼ "a" dimension 206 above the centerline. The other two ridges are disposed at approximately ¼ "a" dimension 208 below centerline. In one embodiment, the mirror image first and second sections of these configurations in the H-plane offset transition are well matched.

In one embodiment, the first double-ridged T waveguide 108 includes a broad wall dimension 210 approximately ½ "a" dimension 204 of the quad-ridged transition 202 electrically couples to the first section 216 of the quad-ridged transition 202. In operation, the second section 218 of the quad-ridged transition 202 is electrically coupled to a metallic short on the waveguide rotor 104.

Similarly, the second double-ridged T waveguide 106 also has a broad wall dimension 214 approximately ½ "a" 204 of the quad-ridged transition 202. In this case, the T waveguide 106 mates to the second section 218 of the quad-ridged transition 202, while the first section 216 mates to a metallic short on the waveguide rotor 104.

The bypass waveguides 110, 112, utilize an H-plane offset transition 200 as with the first T waveguide 108. The bypass ports 130, 132, 134, 136 are configured just as the first and second T ports 122, 124. The bypass waveguides 110, 112 are also double-ridged waveguides in this embodiment.

Alignment of ridges or even the waveguide edges need not be precise, although more accurate alignment can be used to improve the transmission properties.

Figure 3:
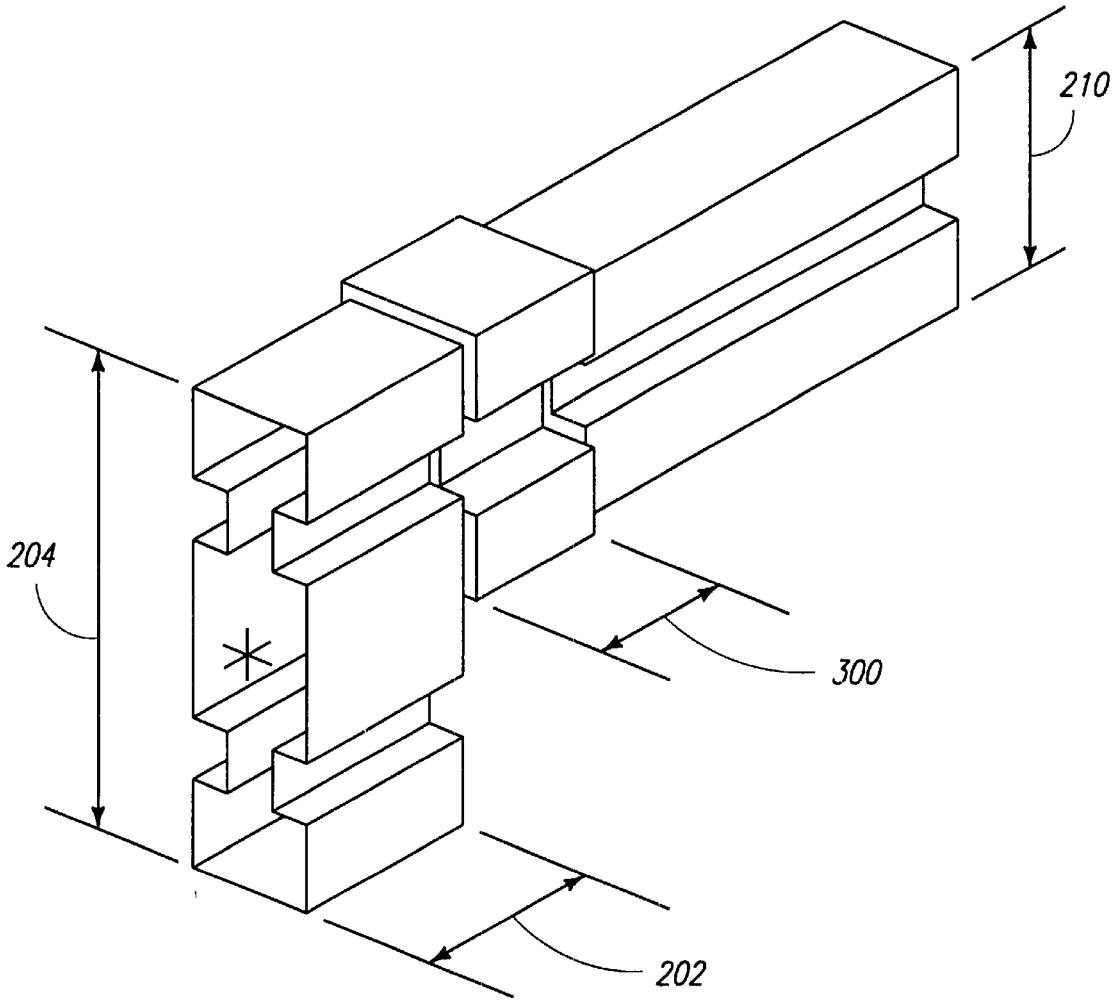
FIG. 3 illustrates the intermediate waveguide section.

FIG. 3 illustrates another embodiment of the invention, using an intermediate waveguide section 300. The intermediate waveguide section 300 is positioned between the quad-ridged transition 202 and the ½ "a" dimension T waveguide 108 to further improve transmission properties through the waveguide switch 100.

Figure 4A:
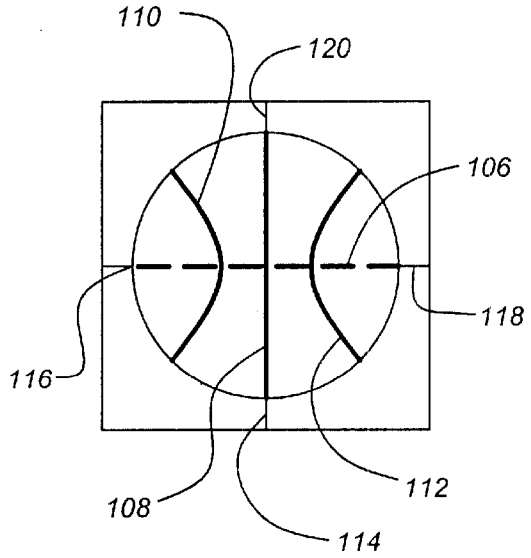
FIGS. 4A–4C are schematic diagrams of an embodiment of the present invention shown with the T switch and bypass waveguides activated.
Figure 4B:
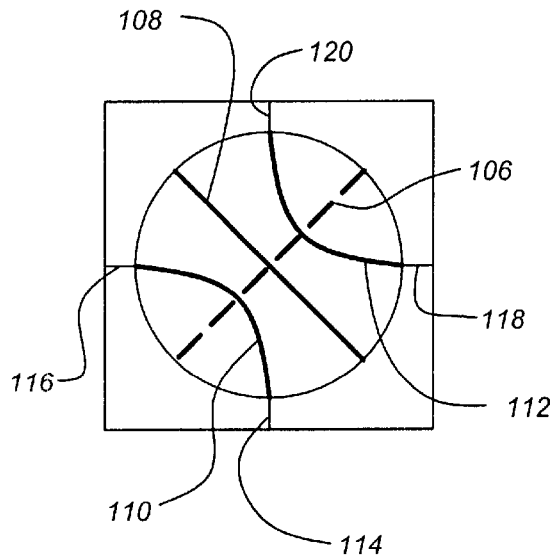
Figure 4C:
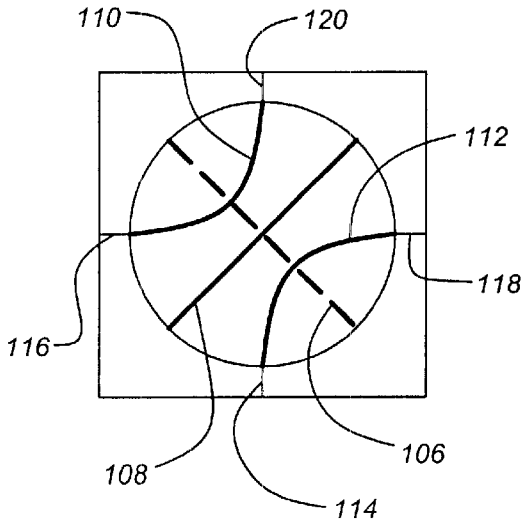

FIGS. 4A–4C are schematic diagrams of an embodiment of the present invention shown with the T and bypass waveguides activated in a first, second and third rotary position of the waveguide rotor 104. The two bypass waveguides 110, 112 and T waveguide 108 of the first layer 138 are depicted in the waveguide rotor 104, along with the second T waveguide 106 of the second layer 140.

FIG. 4A shows the T switch activated in a first position of the waveguide rotor 104. The first and second T ports 122, 124 of the first T waveguide 108 connect the first fourth housing ports 114, 120. The third and fourth T ports 126, 128 of the second T waveguide 106 connect the second and third housing ports 116, 118.

FIG. 4B shows the bypass waveguides 110, 112 activated in a second position of the waveguide rotor 104. The first and second bypass ports 130, 132 of the first bypass waveguide 110 connect the first and second housing ports 114, 116. The third and fourth bypass ports 128, 130, of the second bypass waveguide 112 connect the third and fourth housing ports 118, 120.

FIG. 4C shows the bypass waveguides 110, 112 activated in a third position of the waveguide rotor 104. The first and second bypass ports 130, 132 of the first bypass waveguide 110 connect the second and fourth housing ports 116, 120. The third and fourth bypass ports 128, 130 of the second bypass waveguide 112 connect the first and third housing ports 114, 118.

H-plane, offset waveguide transitions 200, 212 can be used to great advantage in many applications, such as the T switch embodiment previously described. The bypass waveguides 106, 108 can be disposed on the second plane.

Many modifications may be made to this configuration without departing from the scope of the present invention. For example, other waveguide heights may also be employed and different numbers of ports may be disposed at various locations and in different combinations around the circumference of the waveguide rotor 104 and housing 102. Bends can also be incorporated, either in the waveguide rotor 104 or housing 102, to create axial ports, positioned at first and/or second surfaces of the waveguide rotor 104 and housing 102 rather than around the circumference. Those skilled in the art will recognize that any combination of the above components, or any number of different components and other devices, may be used with the present invention.

Conclusion

This concludes the description of the preferred embodiments of the present invention. The present invention describes an apparatus and method for switching between a T switch waveguide and a bypass waveguide among a plurality of housing ports using H-plane offset transitions.

An apparatus and method for switching waveguides between T switch and a bypass waveguide is described. The apparatus comprises a housing having a first, second, third and fourth housing port and a waveguide rotor, having a first and second rotary position. The waveguide rotor includes a first T waveguide, having a first and second T port, for connecting the first and fourth housing ports in the first rotary position, a second T waveguide having a third and fourth T port, for connecting the second and third housing ports in the first rotary position and a bypass waveguide, having a first and second bypass port, for connecting the first and second housing ports in the second rotary position. The first and second rotary positions are alternately selectable by rotating the waveguide rotor.

The method comprises rotating a waveguide rotor including a first T waveguide having a first and second T port, a second T waveguide having a third and fourth T port and a bypass waveguide having a first and second bypass port, to a first rotary position in a housing including a first, second, third and fourth housing port, whereby the first and second T ports connect the first and fourth housing ports and the third and fourth T ports connect the second and third housing ports. And rotating the waveguide rotor to a second rotary position, whereby the first and second bypass ports connect the first and second housing ports.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A waveguide switch comprising:

a housing having a first, second, third and fourth housing port; and a waveguide rotor, having a first and second rotary position, including:

a first T waveguide, having a first and second T port, for connecting the first and fourth housing ports in the first rotary position;

a second T waveguide having a third and forth T port, for connecting the second and tired housing ports in the first rotary position;

a fist bypass waveguide, having a first and second bypass port for connecting the first and second housing ports in the second rotary position; and a second bypass waveguide, having a third and fourth bypass port for connecting the third and fourth housing ports in the second rotary position and the second and fourth housing ports in the third rotary position;

wherein the first and second rotary positions are alternately selectable by rotating the waveguide rotor and the waveguide rotor has a third rotary position, alternately selectable with the first and second rotary positions, and whereby the first bypass waveguide connects the first and third housing ports in the third rotary position and wherein all of the housing ports comprise quad-ridges.

2. The waveguide switch of claim 1, wherein all of the housing ports each have an first and second section that are each electrically matched to the T ports and bypass ports.

3. The waveguide switch of claim 2, wherein the waveguide rotor shorts the second section of the first and fourth housing ports and the first section of the second and third housing ports in the first rotary position and shorts second section of all the housing ports in the second and third rotary positions.

4. The waveguide switch of claim 2, wherein the fast and second T ports are connectable to the first section of the housing ports and the third and fourth T ports are connectable to the second section of the housing ports.

5. The waveguide switch of claim 2, wherein the bypass ports are connectable to the first section of the housing ports.

6. The waveguide switch of claim 1, wherein the T ports and the bypass ports each include an intermediate waveguide section.

7. The waveguide switch of claim 6, wherein the intermediate waveguide section comprises a double-ridge.

8. The waveguide switch of claim 1, wherein the T waveguides and the bypass waveguides are double-ridged.

9. The waveguide switch of claim 1, wherein the first T waveguide is positioned in a first plane above and substantially orthogonal to the second T waveguide.

10. The waveguide switch of claim 1, wherein a first pair of the housing port ridges are positioned approximately one quarter of a first dimension of the housing port below a center of the housing port and a second pair of the housing port ridges are positioned approximately one quarter of the first dimension above the center.

11. A method for switching waveguides, comprising:

rotating a waveguide rotor including a first T waveguide having a first and second T port, a second T waveguide having a third and fourth T port and a bypass waveguide having a first and second bypass port, to a first rotary position in a housing including a first, second, third and fourth housing port, whereby the first and second T ports connect the first and fourth housing ports and the third and fourth T ports connect the second and third housing ports;

rotating the waveguide rotor to a second rotary position, whereby the first and second bypass ports connect the first and second housing ports;

rotating the waveguide rotor to a third rotary position whereby the first bypass waveguide connects tie first and third housing ports in the third rotary position wherein the waveguide rotor further includes a second bypass waveguide, having a third and fourth bypass port for connecting the third and fourth housing ports in the second rotary position and the second and fourth housing ports in the third rotary position.

12. The method of claim 11, wherein all of the housing ports each have an first and second section that are each electrically matched to the T ports and bypass ports.

13. The method of claim 12, further comprising: shorting the second section of the first and fourth housing ports and the first section of the second and third housing ports in the first rotary position and shorting the second section of all the housing ports in the second and third rotary positions.

14. The method of claim 12, wherein the first and second T ports are connectable to the first section of the housing ports and the third and fourth T ports are connectable to the second section o the housing ports.

15. The method of claim 12, wherein the bypass ports are connectable to the first section of the housing ports.

16. The method of claim 11, wherein all of the housing ports comprise a quad-ridge.

17. The method of claim 16, wherein a first pair of the housing port ridges are disposed approximately one quarter of a first dimension of the housing port below a center of the housing port and a second pair of the housing port ridges are disposed approximately one quarter of the first dimension above the center.

18. The method of claim 11, wherein the T waveguides and the bypass waveguides comprise a double-ridge.

19. The method of claim 11, wherein the first T waveguide is disposed in a first plane above and substantially orthogonal to the second T waveguide.

20. The method of claim 11, wherein the T ports and the bypass ports each include an intermediate waveguide section.

21. The method of claim 20, wherein the intermediate waveguide section comprises a double-ridge.

22. A waveguide switch comprising:

a waveguide rotor having a first and second rotary position, including:

a first rotor port, having as first H-plane offset transition;

a second rotor port, having a second H-plane offset transition and a mirror image configuration of the first rotor port; and a housing port having an first and second section;

wherein the first and second rotor ports are electrically matched with first and second sections, respectively, of the housing port and the first rotor port is engaged with the first section of the housing port in the first rotary position and the second rotor port is engaged with the second section of the housing port in the second rotary position.

23. The waveguide switch of claim 22, wherein the first and second rotor ports are respectively connected to a first and second T waveguide.

24. The waveguide switch of claim 23, wherein the first and second T waveguides are double-ridged.

25. The waveguide switch of claim 23, wherein the first T waveguide is positioned in a first plane above and substantially orthogonal to the second T waveguide.

26. The waveguide switch of claim 22, wherein at least one of the first and second rotor ports includes an intermediate waveguide section.

27. The waveguide switch of claim 26, wherein the intermediate waveguide section comprises a double-ridge.

28. The waveguide switch of claim 22, wherein the second section of the housing port is shorted in the first rotary position and the first section of the housing port is shorted in the second rotary position.

29. The waveguide switch of claim 22, the housing port comprises quad-ridges.

* * * * *